United States Patent [19]

Knapp, Jr.

[11] 4,227,168

[45] Oct. 7, 1980

[54] FUSIBLE ELEMENT FOR ELECTRIC FUSES BASED ON M-EFFECT

[75] Inventor: Edward J. Knapp, Jr., Salisbury, Mass.

[73] Assignee: Gould Inc., Rolling Meadows, Ill.

[21] Appl. No.: 44,093

[22] Filed: May 31, 1979

[51] Int. Cl.[3] ..... H01H 85/12

[52] U.S. Cl. ..... 337/161; 337/296; 337/295

[58] Field of Search ..... 337/160, 161, 163, 164, 337/166, 293, 295, 296

[56] References Cited

U.S. PATENT DOCUMENTS

| | | | |
|---|---|---|---|
| 2,988,620 | 6/1961 | Kozacka | 337/296 X |
| 3,116,389 | 12/1963 | Withers | 337/293 X |
| 3,123,693 | 3/1964 | Kozacka | 337/296 X |
| 3,523,265 | 8/1970 | Feenan et al. | 337/295 X |
| 4,118,684 | 10/1978 | Möllenhoff | 337/296 |
| 4,146,863 | 3/1979 | Möllenhoff | 337/296 |

*Primary Examiner*—George Harris

*Attorney, Agent, or Firm*—Erwin Salzer

[57] ABSTRACT

A fusible element for electric fuses based on M-effect, i.e. the severing of a high fusing point base metal by a low fusing point overlay metal by a process of metal interdiffusion. The M-effect, or Metcalf effect, as widely used in electric fuses, has a main limitation consisting in requiring too long periods of time for severing the base metal. The problem of severing the base metal by the overlay metal in shorter times is solved, according to this invention, by arranging the overlay metal on the front side and on the rear side of the base metal, in spaced relation to a point of reduced cross-section of the base metal.

While the invention is applicable to all M-effect fuses, it is of particular importance in regard to Standard for Class L fuses of the Underwriters Laboratories Inc. which have fusible elements that are of copper, as distinguished from Class L fuses having fusible elements of silver, or Class L fuses having fusible elements in part of copper, and in part of silver.

7 Claims, 7 Drawing Figures

FUSIBLE ELEMENT FOR ELECTRIC FUSES BASED ON M-EFFECT

BACKGROUND OF THE INVENTION

The so-called M-effect differs very much depending upon whether the base metal is silver or copper. Where the base metal is silver, a severing of the silver base ribbon can be achieved in such a way as to comply with most existing time-current curve requirements.

These requirements cannot be met in many instances where the base metal is copper, or an alloy of copper.

The operation of fusible elements under consideration is governed by Fick's laws of diffusion. Therefore a ribbon of a base metal could be severed more rapidly by an overlay metal if the overlay metal could be arranged on both sides of the base metal so to interact with the base metal on two interfaces thereof. However, this method has proven not to be feasible because affixing of the second overlay metal results in melting of the first overlay metal, and initiates the metallurgical reaction of the first overlay metal intended to ultimately sever the base metal. This premature effect of the first overlay metal on the base metal resulting in a premature alloy formation of both metals is also referred-to as ageing of the base metal.

RELATED PATENTS

The prior art patents known to applicant and believed by him to be most pertinent to his present invention are listed below:

U.S. Pat. No. 4,118,684; Oct. 3, 1968 for ONE PIECE FUSIBLE CONDUCTOR FOR LOW VOLTAGE FUSES to Klaus Möllenhoff;

Brit. Pat. No. 1,523,575; Sept. 6, 1978 for FUSIBLE ELECTRIC CONDUCTORS to Siemens Aktiengesellschaft.

SUMMARY OF THE INVENTION

A ribbon type fusible element embodying this invention includes a base metal having a relatively high fusing point and an overlay metal having a relatively low fusing point and capable of severing by a diffusion process the current path through said base metal. The novel features of this invention comprise, in combination, (a) a base metal having a front side and a rear side and defining a point of reduced cross-section; (b) a first overlay metal on said base metal arranged on said front side of said base metal in spaced relation from said point of reduced cross-section; and (c) a second overlay metal arranged on said rear side of said base metal in spaced relation from said point of reduced cross-section. As a result of this arrangement, upon fusion of said first overlay metal and upon fusion of said second overlay metal two oppositely directed metal jets flow toward said point of reduced cross-section of said base metal and sever said base metal at said point of reduced cross-section.

The first overlay metal and the second overlay metal are preferable the same metals having the same fusing point and are arranged symmetrically in regard to said point of reduced cross-section.

DESCRIPTION OF PREFERRED EMBODIMENT

Figure 1:
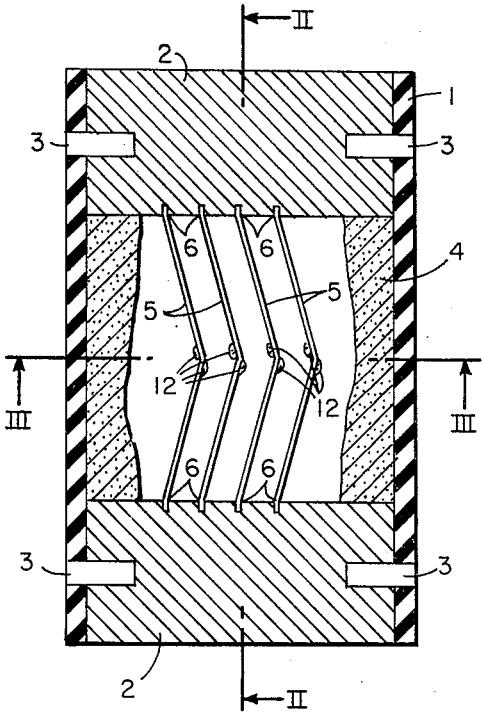
FIG. 1 is a longitudinal section of a Underwriters Laboratories Inc. Standard Class L fuse embodying the present invention.
Figure 3:
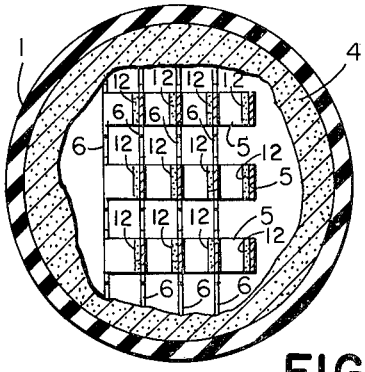
FIG. 3 is a section along III—III of FIG. 1.
Figure 2:
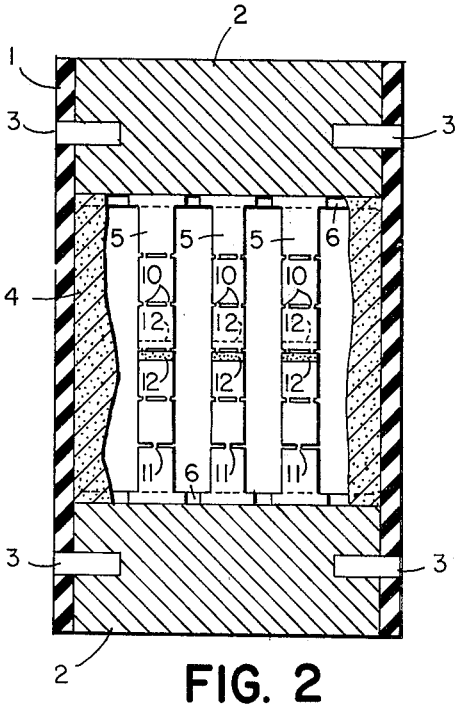
FIG. 2 is a section along II—II of FIG. 1.

In the drawings numeral 1 has been applied to indicate a tubular casing of electric insulating material such as, for instance, glass-cloth melamine. A pair of terminal elements or terminal plugs 2 are inserted into casing 1 and close the same. Terminals 2 are of an electroconductive material such as copper or brass. Steel pins 3 interconnect casing 1 and terminal elements 2. An arc-quenching filler 4, including quartz sand, is filled into casing 1. In FIGS. 1 and 2 filler 4 has been shown only adjacent the interface with casing 1, but it is actually intended to fill all of casing 1 not occupied by other parts. A plurality of ribbon-type fusible elements 5 inside of casing 1 and immersed in filler 4 conductively interconnects terminals 1. In the embodiment shown there are $4\times3=12$ fusible elements 5. All twelve fusible elements may be of silver or copper, or of an alloy of copper, considered in the trade as copper. The axially outer ends of elements 5 are inserted into grooves 6 provided in terminals 1 and conductively connected, as by solder joints not shown, with terminals 1. Fusible elements 5 are bent in their center into two sections which enclose an obtuse angle. Each of fusible eleemnts 5 has a plurality of relatively large, rectangular perforations 7, extending transversely across fusible elements 5 and being only of slightly shorter length than the width of fusible elements 5. Each of fusible elements 5 further has a pair of relatively small rectangular perforations 8. Perforations 8 are open at the lateral edges 14 of said plurality of fusible elements 5. Perforations 7 and 8 are aligned in a direction transversely of fusible elements 5. All of perforations 7 are congruent, and all of perforations 8 are congruent. Each of said plurality of relatively large perforations 7, and each of said plurality of relatively small perforations 8, define therebetween a pair of points of reduced cross-section or a pair of parallel, short and narrow current paths 10,10. These current paths 10,10 have such a small cross-sectional area that they may be considered as point heat sources when the fuse is carrying current. Each fusible element further includes an additional point of reduced cross-section 11. The cross-section of points 11 is smaller than the cross-section of parallel current paths 10,10 and, therefore, the total $i^2 \cdot t$ of each of points 11 is relatively small compared to the total $i^2 \cdot t$ of each parallel path 10,10. Total $i^2 \cdot t$ means the $i^2 \cdot t$ needed for raising the temperature of points 10,10 and 11, respectively, from room temperature to fusing temperature, plus the $i^2 \cdot t$ needed for providing the latent heat of fusion of points 10,10 and 11, respectively, plus the $i^2 \cdot t$ needed for raising the temperature of points 10,10 and 11, respectively, from fusing temperature to vaporization temperature, and the $i^2 \cdot t$ needed for providing the latent heat of vaporization of points 10,10 and 11, respectively. Points 10,10 and 11 are spaced equidistantly. Therefore one of the pair of parallel current paths 10,10 of each of said plurality of fusible elements is positioned immediately adjacent the center of each of said plurality of fusible elements, i.e. immediately adjacent plane III—III. In that region the temperature of fusible elements 5 is at, or close to, its peak when the fuse is carrying current. A plurality of pairs of overlays 12 of an M-effect metal—i.e. a metal having a much lower fusing temperature than its supporting base metal and capable of severing the latter by a metallurgical reaction in the nature of an interdiffusion process—is provided on fusible elements 5. One or the first overlay 12 is provided on the front side of each fusible element 5, and one or the other or second overlay is provided on the rear side of each fusible element 5. Overlays 12 are located immediately adjacent the centers of fusible elements 5, where their temperature is highest. Overlays 12 are arranged immediately adjacent to, but in spaced relation from, said points of reduced cross-section 10,10 or pair of parallel current paths 10,10 of each of said plurality of fusible elements 5. Each overlay 12 has a first boundary line substantially coextensive with one of the edges of the center aperture 7 of a fusible element 5, and has a second boundary line remote from the center aperture 7 of a fusible element 5. The first mentioned boundary line is a substantially straight line extending across the entire width W of each fusible element 5. As long as overlays 12 are in their solid rather than their liquid state, they are spaced from the points of reduced cross-section or parallel current paths 10,10, and do not overlap the latter. A single point of reduced cross-section 10 is sufficient to put the invention into effect. The parallel current paths 10,10 are, however, the preferred embodiment of the invention.

Current paths 10,10 immediately adjacent to plane III—III are severed with time delays as a result of the smallness of heat flow from points of reduced cross-section 10,10 to overlays 12, the relatively large mass of the latter, their latent heat of fusion and the time involved in the flow of metal of which overlays 12 are made from their initial locations to each of said pair of immediately adjacent points of reduced cross-section or current paths 10,10. Since overlays 12 extend across the entire width W of fusible elements 5, the heat flow from points of reduced cross-section 10,10 to overlays 12 is so small that sufficient time elapses in case of overloads before overlays 12 melt. Thus the requirement of the Underwriters Laboratories Standard for Class L fuses of clearing times of 240 minutes when the load current is 150 percent of the rated current can be met; but when overlays 12 fuse, interruption is effected at a very rapid rate.

Before overlays 12 fuse, there will be a current flow in the direction from points of reduced cross-section or parallel current paths 10,10 toward overlays 12. After overlays 12 are liquefied, the metal of which they are made spills over points of reduced cross-section or parallel current paths 10,10 and severs the same. This is effected by three phenomena. First, the temperature gradient between overlays 12 and points of reduced cross-section or parallel current paths 10,10 may be high. The melting temperature of overlays 12 may be around 200° C., while the temperature at points of reduced cross-section or parallel current paths 10,10 may be, e.g., in the order of 400° C. or more. The M-effect metal, when liquefied, tends to flow rapidly from its initial position to locations where the temperature is higher. It will, therefore, flow rapidly to parallel current paths 10,10. There the diffusion between overlay metal and base metal will be rapid, because the rate of diffusion increases with increasing temperature. Since the diffusion of the overlay metal occurs from the front side of the base metal to the rear side thereof, and from the rear side of the base metal to the front side thereof, the severing time will be greatly reduced. Initially two arcs are formed, one of each of the points of reduced cross-section or parallel current paths 10,10. But arcs in parallel are unstable. Therefore, one arc will extinguish, and the other arc gap will be caused to carry the entire current, thus increasing the velocity of backburn.

Figure 4:
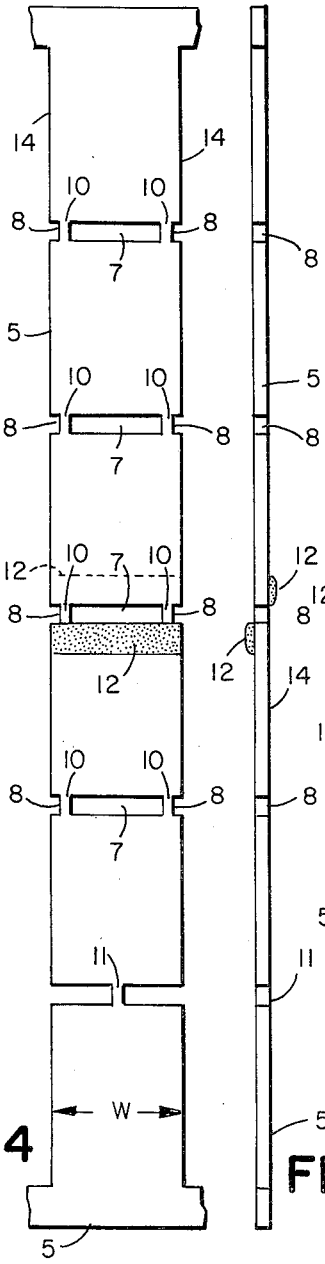
FIG. 4 shows in front view a preferred ribbon-type fusible element of the structure of FIGS. 1 to 3 on a scale larger than 1:1.
Figure 5:
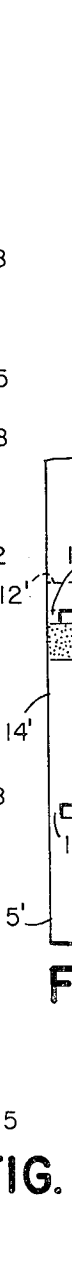
FIG. 5 is a side elevation of the fusible element shown in FIG. 4 drawn on the same scale as FIG. 4.
Figure 6:
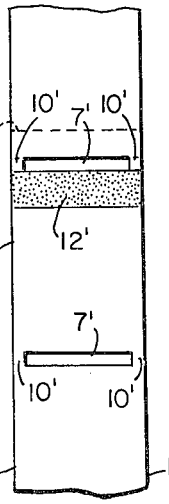
FIG. 6 shows in front view the center portion only of a modification of the fusible element of FIGS. 4 and 5.
Figure 7:
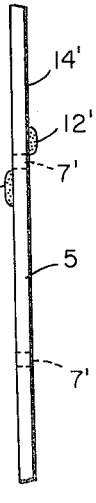
FIG. 7 is a side elevation of FIG. 6.

In FIGS. 6 and 7, the same reference numerals as in FIGS. 4 and 5 with a prime added have been applied to indicate like parts. The fusible element 5' has relatively large rectangular serially arranged perforations 7' all of which are congruent. The center perforation 7' is provided with a pair of M-effect overlays 12', one to each side of fusible element 5'. The small perforations 8 of FIGS. 4 and 5 have been deleted in FIGS. 6 and 7. The structures of FIGS. 6 and 7 operate theoretically in the same way as those of FIGS. 4 and 5, but in practice the performance of fuses having fusible elements as shown in FIGS. 4 and 5 is far superior to that of fuses having fusible elements as shown in FIGS. 6 and 7. The reason underlying this fact is as follows. In any kind of copper strip of which fusible elements 5 and 5' are made, the longitudinal edges 14 and 14 , respectively, are somewhat fuzzy. This fuzziness results in that the cross-section of current-paths 10',10' cannot be absolutely identical, and consequently their $i^2 \cdot t$ values cannot be absolutely the same.

The punch with which the fusible elements of FIGS. 4 and 5 are made removes this drawback by removing the edges 14 where their possible fuzziness may affect the cross-section of the points of reduced cross-section or parallel current paths 10,10. Thus the latter are absolutely identical within the limits of punching technology.

The operation of fuses embodying this invention has been stated above and will be briefly summarized below.

On overload currents the temperatures of points of reduced cross-section or current paths 10,10 is above that of overlays 12, the degree of overheating of current paths 10,10 depending on the degree of the overload current. When overlays 12 are liquefied, they spill over points of reduced cross-section or parallel current paths 10,10 and sever the latter simultaneously from the front side and the rear side thereof.

The structure shown in the drawings is an Underwriters Laboratories Class L fuse. Different requirements may have an effect on the geometry of the points of reduced cross-section 10, e.g. there may be but one rather than two parallel current paths in each fusible element, and the point of reduced cross-section may not be pointlike but have a considerable length.

Overlays 12 may be established by heating the portion of fusible elements 5 on which they are to be established, and not heating the opposite ends of the fusible elements 5. Under such conditions the temperature at the points of reduced cross-section or current paths 10,10 which separate the relatively hot from the relatively cold portion of each fusible element remains relatively low. Some insignificant amounts of M-effect metal, such as tin, or alloys thereof, may however be deposited on the side of the points of reduced cross-section or current paths 10,10 immediately adjacent overlays 12. The height of overlay metal on current paths 10,10 will be much smaller at the overlays 12 proper, and no instances have ever been observed where the entire current paths 10,10 were covered by overlay metal.

I claim as my invention:

1. A ribbon-type fusible element for electric fuses including a base metal having a relatively high fusing point and an overlay metal having a relatively low fusing point and capable of severing by a diffusion process the current path through said base metal comprising in combination (a) a base metal having a front side and a rear side and defining a point of reduced cross-section;

(b) a first overlay metal on said base metal arranged on said front side of said base metal in spaced relation from said point of reduced cross-section;

(c) a second overlay metal on said base metal arranged on said rear side of said base metal in spaced relation from said point of reduced cross-section; whereby (d) upon fusion of said first overlay metal and upon fusion of said second overlay metal two oppositely directed metal jets flow toward said point of reduced cross-section of said base metal and sever said base metal at said point of reduced cross-section.

2. A ribbon-type fusible element as specified in claim 1 wherein said first overlay metal and said second overlay metal are arranged symmetrically in relation to said point of reduced cross-section of said base metal.

3. A ribbon-type fusible element as specified in claim 1 wherein said base metal is copper or an alloy thereof.

4. A ribbon-type fusible element as specified in claim 1 wherein (a) said base metal has two points of reduced cross-section arranged along a substantially transverse line of said base metal and forming two parallel current paths of reduced cross-section;

(b) said first overlay metal extends across the entire width of said base metal and is thus juxtaposed to both said points of reduced cross-section; and (c) said second overlay metal extends across the entire width of said base metal and is thus juxtaposed to both said points of reduced cross-section.

5. A ribbon-type fusible element for electric fuses including a base metal having a relatively high fusing point and an overlay metal having a relatively low fusing point and capable of severing the current path through said base metal comprising in combination (a) a base metal having a front side and a rear side and having an elongated substantially rectangular relatively long perforation extending substantially in a transverse direction of said base metal;

(b) said base metal further having a pair of substantially rectangular relatively short perforations each to opposite sides of said relatively long perforation, said relatively short perforations being open along the lateral edges of said base metal;

(c) said relatively long perforation and said relatively short perforations defining a pair of parallel current paths therebetween;

(d) a first overlay metal arranged on said front side of said base metal extending across the entire width thereof and arranged in spaced relation from said pair of parallel current paths;

(e) a second overlay metal arranged on said rear side of said base metal extending across the entire width thereof and arranged in spaced relation from said pair of parallel current paths; whereby (f) upon fusion of said first overlay metal and upon fusion of said second overlay metal two oppositely directed metal jets flow to said pair of parallel current paths and sever said base metal at said points of parallel current paths.

6. A ribbon-type fusible element as specified in claim 5 wherein said first overlay metal and said second overlay metal are arranged symmetrically in relation to said pair of parallel current paths and contain tin.

7. A ribbon-type fusible element as specified in claim 5 wherein said base metal is copper or an alloy of copper.

* * * * *